US012442254B2

(12) United States Patent
Masdea

(10) Patent No.: US 12,442,254 B2
(45) Date of Patent: Oct. 14, 2025

(54) SPLIT BLADE DRILL BIT

(71) Applicant: Schlumberger Technology Corporation, Sugar Land, TX (US)

(72) Inventor: James Masdea, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 265 days.

(21) Appl. No.: 18/346,195

(22) Filed: Jun. 30, 2023

(65) Prior Publication Data

US 2025/0003293 A1 Jan. 2, 2025

(51) Int. Cl.
*E21B 10/55* (2006.01)
*E21B 10/43* (2006.01)

(52) U.S. Cl.
CPC ..... *E21B 10/55* (2013.01); *E21B 10/43* (2013.01)

(58) Field of Classification Search
CPC ..... E21B 10/55; E21B 10/42–43
See application file for complete search history.

(56) References Cited

U.S. PATENT DOCUMENTS

| | | | | |
|---|---|---|---|---|
| 5,417,296 | A | 5/1995 | Murdock | |
| 5,443,565 | A | 8/1995 | Strange, Jr. | |
| 5,819,860 | A * | 10/1998 | Newton | E21B 10/567 175/399 |
| 6,302,223 | B1 * | 10/2001 | Sinor | E21B 10/573 175/408 |
| 11,015,394 | B2 | 5/2021 | Casad | |
| 2011/0005837 | A1 | 1/2011 | Hoffmaster | |
| 2018/0266185 | A1 | 9/2018 | Russell | |
| 2019/0106942 | A1 | 4/2019 | Azar | |
| 2019/0136633 | A1 * | 5/2019 | Schoen | E21B 10/42 |
| 2019/0136635 | A1 * | 5/2019 | Casad | E21B 10/42 |
| 2021/0071479 | A1 * | 3/2021 | Deen | E21B 10/43 |
| 2022/0243538 | A1 | 8/2022 | Case | |

* cited by examiner

*Primary Examiner* — Theodore N Yao
(74) *Attorney, Agent, or Firm* — Jeffrey D. Frantz

(57) ABSTRACT

Drilling bits for removing material from a formation are provided. One such bit includes a bit body including a first gauge pad and a second gauge pad. The bit further includes a first blade including a leading portion and a trailing portion, where the leading portion is disposed on the first gauge pad with a negative helix angle and the trailing portion is disposed on the second gauge pad with a positive helix angle.

12 Claims, 5 Drawing Sheets

SPLIT BLADE DRILL BIT

BACKGROUND

The present disclosure relates generally to drilling tools and, more specifically, to drilling tools, such as a drill bit.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. A variety of drilling methods and tools may be utilized depending partly on the characteristics of the formation through which the wellbore is drilled.

A drilling system may use a variety of bits in the creation, maintenance, extension, and abandonment of a wellbore. Bits include drilling bits, mills, reamers, hole openers, and other cutting tools. Some drilling systems rotate a bit relative to the wellbore to remove material from the sides and/or bottom of the wellbore. Some bits are used to remove natural material from the surrounding geologic formation to extend or expand the wellbore. For instance, so-called fixed cutter or drag bits, or roller cone bits, may be used to drill or extend a wellbore, and a reamer or hole opener may be used to remove formation materials to extend or widen a wellbore. Some bits are used to remove material positioned in the wellbore during construction or maintenance of the wellbore. For example, bits are used to remove cement, scale, or metal casing from a wellbore during maintenance, creation of a window for lateral drilling in an existing wellbore, or during remediation.

Often times, optimizing design variables for one formation or set of parameters leads to sacrificing of performance or durability in other conditions. As drilling intervals increase in length to encompass multiple formations, cutting structures are increasingly compromised to guarantee reliability, costing the operator time and money.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Present embodiments are directed to drilling tools, such as drill bits. The design consists of a cutting structure with blades that split in different directions at a given radial location. The rotationally leading portion of the forked blade sweeps forward. This forward sweep separates the leading portion from the trailing portion, and creates a geometry that may have a hydraulic cleaning advantage. The trailing portion of the blade sweeps rearward to increase separation between the portions and allow space for a hydraulic nozzle between the two.

The forward and rearward swept portions of the blades are intentionally kept joined as one solid body geometrically. This creates unique flow areas for the nozzles inside and outside of the split portion of the blade. The outside portion of the blade may require greater number of nozzles to clean the larger number of cuttings at high depth of cut. Each portion of the forked blade has its own unique gauge pad. These gauge pads may be at independent swept angles in order to optimize the space between them for cuttings evacuation.

The cutting elements on the two portions of the forked blade may have unique shapes or grades, be at independent positions and have independent back rake and side rake angles. The increasing distance along the blade between locations on the forward fork and the rearward fork creates a loading force on each cutting element that varies with depth of cut. The rearward fork cutting elements are partially obstructed by the forward fork cutting elements at high depth of cut, leading to a load difference between the two. At low depth of cut, the obstruction is lower allowing for similar loading across the two portions of the blade.

An embodiment includes a bit for removing material from a formation, the bit having a bit body having a first gauge pad and a second gauge pad and a first blade having a leading portion and a trailing portion, wherein the leading portion is disposed on the first gauge pad with a negative helix angle and the trailing portion is disposed on the second gauge pad with a positive helix angle.

Another embodiment includes a bit for removing material from a formation, the bit having a bit body having a first gauge pad and a second gauge pad and a first blade having a first leading portion and a first trailing portion, wherein the first leading portion is disposed on the first gauge pad and the first trailing portion is disposed on the second gauge pad such that there is a first helix angle differential of at least a first threshold value between the first leading portion and the first trailing portion.

An additional embodiment includes a bit for removing material from a formation, the bit having a bit body having a first gauge pad and a second gauge pad and a first blade having a first leading portion and a first trailing portion, wherein the first leading portion is disposed on the first gauge pad with a forward sweeping orientation in a first direction towards rotation of the bit when the bit is in operation and the first trailing portion is disposed on the second gauge pad with a rearward sweeping orientation in a second direction away from the rotation of the bit when the bit is in operation.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
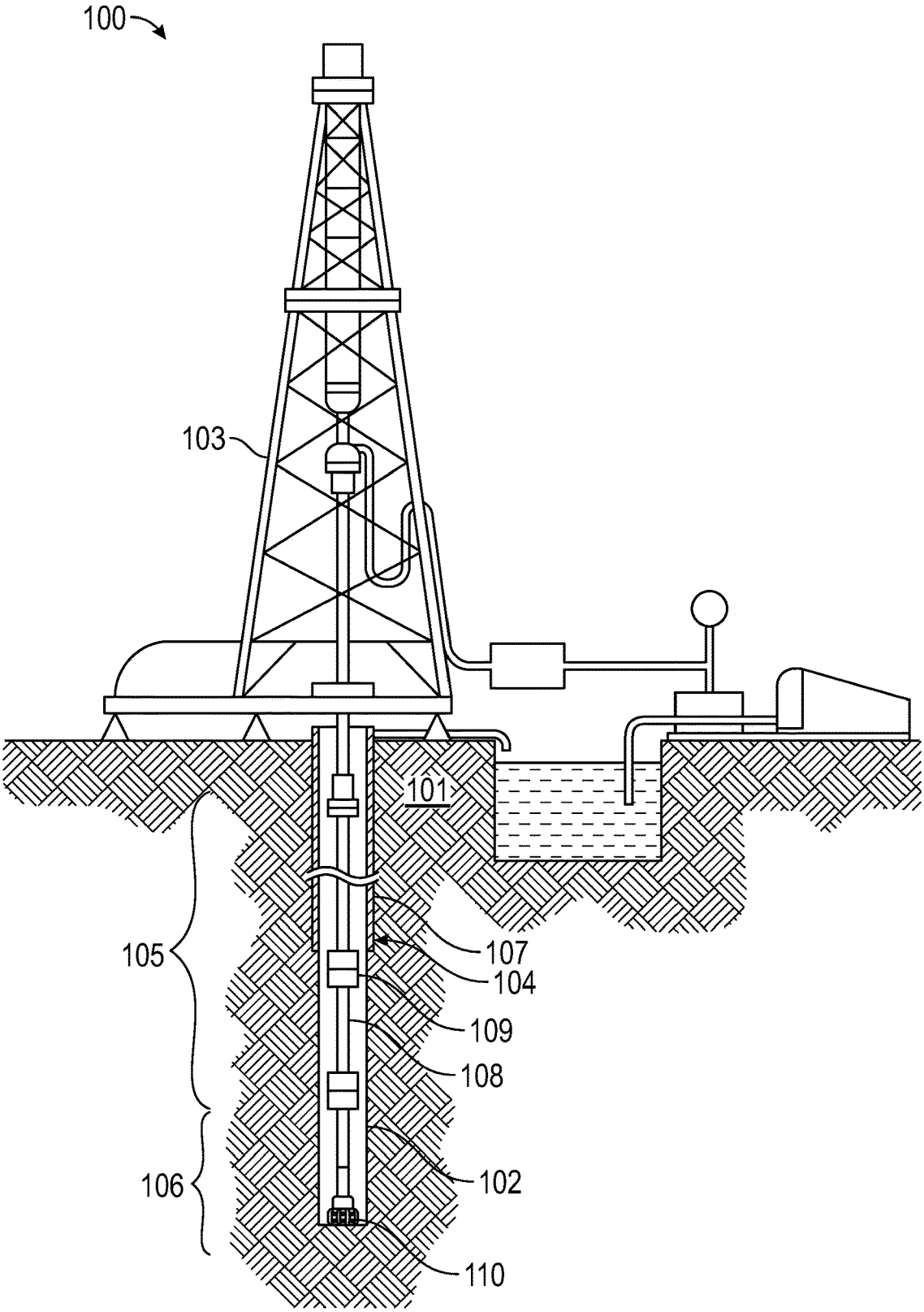
FIG. 1 is a schematic view of a drilling system, in accordance with embodiments of the present technique.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and enterprise-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Additionally, some embodiments of this disclosure generally relate to a drill bit. While a drill bit for cutting through an earth formation is described herein, it should be understood that the present disclosure may be applicable to other bits such as mills, reamers, hole openers, and other bits used in downhole or other applications.

Present embodiments are directed to drilling tools, such as drill bits. The drill bits described herein include, for example, combined blades that split in opposing directions at a certain radial location due to their helix angle differentials. A helix angle (and its differential) can be described as a reduction in angular location (i.e., azimuthal angle, angle around, or theta) relative to the bit axis between consecutive cutting element positions. The present embodiments include blades that split in opposing directions at a certain radial location due to their helix angle differentials, which operates to create a varying rotational distance between cutting elements, resulting in a load distribution that changes with changing depth of cut. For example, typically a high depth of cut favors bits with few cutting elements and few blades, while low depth of cut typically favors bits with many cutting elements and blades. Using a forked blade concept as described herein allows for use with drilling intervals that contain changing lithology. Thus, the drill bits described herein address issues of compromised performance in long drilling intervals encompassing a wide range of formations and downhole conditions. The use of blade location geometry to change the load of the cutting elements based on depth of cut allows a given cutting structure to be optimized for a broader range of parameters and lithologies.

Additionally, sweeping the leading portion of the blade forward in present embodiments allows for a hydraulic cleaning layout that may be beneficial in high depth of cut scenarios. Furthermore, sweeping the trailing portion of the forked blade rearward allows for an additional nozzle to be fit for the trailing cutting elements, which can advantageously provide for cooling of, for example, the trailing cutting elements. Furthermore, in some embodiments, splitting of the blades allows for more gauge pads (and flow channels) to be implemented, further providing advantages for use in, for example, a wide range of formations and downhole conditions. For example, increasing the gauge pads may increase the stability of the bit. The flow channel formed between the leading blade and the trailing blade may improve one or more of the cleaning and the cooling of the cutting elements on the trailing blade. Moreover, the flow channel formed between the leading blade and the trailing blade may facilitate the placement of a nozzle, thereby improving one or more of the cleaning and the cooling of the cutting elements on the trailing blade.

With the foregoing in mind, FIG. 1 shows one example of a drilling system 100 for drilling an earth formation 101 to form a wellbore 102. The drilling system 100 includes a drill rig 103 used to support and rotate a drilling tool assembly 104 that extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 a connected end-to-end through tool joints 109. The drill string 105 transmits drilling fluid through a central bore and transmits rotational power from the drill rig 103 to the BHA 106. In some embodiments, the drill string 105 further includes additional components, such as subs, pup joints, and so forth. The drill pipe 108 provides a hydraulic passage through which drilling fluid is pumped from the surface. The drilling fluid discharges through nozzles, jets, or other orifices in the bit 110 and/or the BHA 106 for the purposes of cooling the bit 110 and cutting structures thereon, and for transporting cuttings out of the wellbore 102.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The bit 110 may also include other cutting structures in addition to or other than a drill bit, such as milling or underreaming tools. In general, the drilling system 100 may include other drilling components and accessories, such as make-up/break-out devices (e.g., iron roughnecks or power tongs), valves (e.g., kelly cocks, blowout preventers, and safety valves), other components, or combinations of the foregoing. Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading formation or other downhole materials. For instance, the bit 110 may be a drill bit suitable for drilling the earth formation 101. Example types of drill bits used for drilling earth formations are fixed-cutter or drag bits, roller cone bits, and percussion hammer bits. In some embodiments, the bit 110 is an expandable underreamer used to expand a wellbore diameter. In other embodiments, the bit 110 is a mill used for removing metal, composite, elastomer, other downhole materials, or combinations thereof. For instance, the bit 110 may be used with a whipstock to mill into a casing 107 lining the wellbore 102. The bit 110 may also be used to mill away tools, plugs, cement, and other materials within the wellbore 102, or combinations thereof. Cuttings formed by use of a mill may be lifted to surface or may be allowed to fall downhole.

Figure 2:
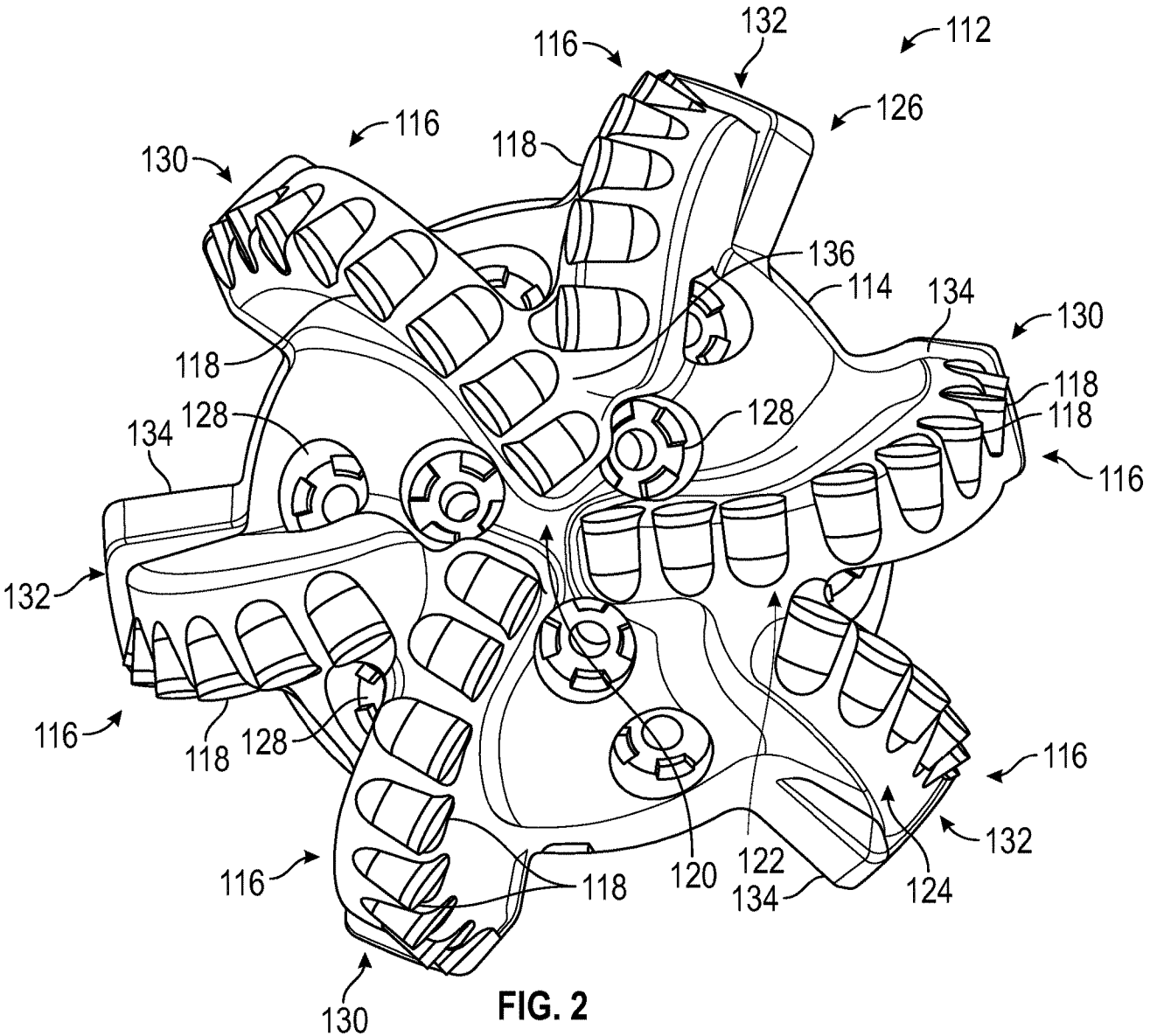
FIG. 2 is a top view of a first embodiment of the bit of the drilling system of FIG. 1, in accordance with embodiments of the present technique.

FIG. 2 is a top view of the downhole end of a drill bit 112 that can be utilized as the drill bit 110 of FIG. 1. The drill bit 112 can be, for example, a fixed-cutter drill bit. As illustrated, the drill bit 112 includes a bit body 114 and blades 116 extending radially and azimuthally therefrom. As illustrated, the blades 116 are combined blades (i.e., forked blades) that split in opposing directions. Each blade 116 additionally may have a plurality of cutting elements 118 (e.g., cutters) connected thereto. In some embodiments, at least one of the cutting elements 118 has a planar cutting face. A planar cutting face may be used to shear the downhole materials, and such a cutting element 118 may be considered a shear cutting element. In other embodiments, at least one of the cutting elements 118 has a non-planar cutting face. A non-planar cutting face may shear, impact/gouge, or otherwise degrade the downhole materials. Examples of non-planar cutting elements 118 (e.g., cutting elements 118 having a non-planar cutting face) include cutting elements with conical, ridged, domed, saddle-shaped, chisel-shaped, or other non-planar cutting faces.

As discussed herein, the cutting elements 118 have a durable or wear resistant surface configured to engage with the formation or other materials encountered during operation. In some embodiments, the cutting elements 118 are configured to degrade the formation via shearing, scraping, or gouging. Additionally, or in the alternative, the cutting elements 118 are configured to reduce the engagement of other cutting elements with the formation or to reduce the wear of the bit blades due to fluid flow or the formation. For example, some cutting elements 118 may be configured as depth of cut limiting elements, particularly when placed in a trailing position immediately behind or adjacent to another cutting element. Cutting elements 118 may include tungsten carbide cutting elements and ultra hard cutting elements. Ultra hard cutting elements may have an ultra hard material arranged on a substrate, such as a tungsten carbide substrate. The ultra hard material may include a superabrasive material such as polycrystalline diamond (PCD), thermally stable diamond, silicon carbide, or polycrystalline cubic boron nitride, among others.

The cutting elements 118 of the drill bit 112 may experience different wear rates in different regions of the bit body 114 or blades 116. In some embodiments, the cutting elements 118 of the drill bit 112 experience different wear rates at of the blades 116. For example, the cutting elements 118 of the nose region 122 may experience higher wear rates than the cutting elements 118 of the gage region 126. In other examples, the cutting elements 118 of the shoulder region 124 experience higher wear rates than the cutting elements 118 of the nose region 122. Additionally, the wear rates may change based upon the type of formation in which the drill bit 112 is utilized (e.g., wear rates to the cutting elements 118 in the cone region 120, nose region 122, shoulder region 124, and/or gage region 126 can differ based on the lithologies in particular formations).

The drill bit 112 also includes fluid ports 128 (e.g., nozzles) disposed in the bit body 114. As illustrated, the layout of the blades 116 allows for fluid ports 128 to be disposed in at least, for example, the cone region 120, the nose region 122, and/or the shoulder region 124. The fluid ports 128 may operate to transmit and/or direct fluid from the drill bit 112 to remove cuttings generated by the drill bit 112 when it is in operation. Additionally, the transmission and/or direction of fluid from the drill bit 112 by the fluid ports 128 allows for cooling of portions of the drill bit 112, for example, cutting elements 118.

As illustrated, one or more of the blades 116 of the drill bit 112 are forked blades (i.e., split blades laid out in a zipper configuration). Each forked blade 116 includes a leading portion 130 and a trailing portion 132. Each of the leading portion 130 and the trailing portion 132 includes its own cutting elements 118 and each of the leading portion 130 and the trailing portion 132 are disposed on distinct and respective gauge pads 134 of the drill bit 112. In some embodiments, some of the blades 116 are forked blades, and other blades 116 have only one leading edge and one trailing edge without any splits. Furthermore, the leading portion 130 and the trailing portion 132 of a forked blade (e.g., split blade) may be separated by a flow channel recessed to the body of the bit. As discussed below, the flow channel between the leading portion 130 and the trailing portion 132 of a forked blade may have a nozzle. The forked blades 116 may split into the leading portion 130 and the trailing portion 132 at the same or different radial locations from the bit axis. One or more of the forked blades 116 may split in the nose region 122, the shoulder region 124, or the gauge region. In some embodiments, a first forked blade 116 splits in the nose region 122, and a second forked blade splits in the shoulder region 124. In some embodiments, the cutting elements 118 on each of the blades 116 are configured to form a shared blade cutting profile. That is, the cutting elements 118 on a first blade share the same cutting profile as the cutting elements on a second blade. Moreover, the cutting elements 118 on the leading portion 130 and the trailing portion 132 of a split blade 116 may be arranged on the same cutting profile.

Additionally, in some embodiments, the leading portion 130 is disposed on the drill bit 112 using a forward helix layout while the trailing portion 132 is disposed on the drill bit 112 using a reverse helix layout. Helix directions (and differential) can be described as a reduction in angular location (i.e., azimuthal angle, angle around, or theta) relative to the bit axis between consecutive cutting element 118 positions. For example, leading portion 130 can have a cutting element 118 disposed at an angle of 10° with the next adjacent cutting element 118 (moving outwards away from the cone region 120) disposed at an angle of 12° such that the helix would be −2°. Likewise, for example, trailing portion 132 can have a cutting element 118 disposed at an angle of 340° with the next adjacent cutting element 118 (moving outwards away from the cone region 120) disposed at an angle of 342° such that the helix would be 2°. This would result in a helix differential of 4° (i.e., the total angular difference between the helix of the leading portion 130 and the trailing portion 132).

The forward helix layout includes the leading portion 130 having a negative degree angle from the location of the split 136 of the leading portion 130 and the trailing portion 132. Likewise, the reverse helix layout includes the trailing portion 130 having a positive degree angle from the location of the split 136 of the leading portion 130 and the trailing portion 132. In this manner, the leading portion 130 and the trailing portion 132 of the blades 116 dovetail away from one another in a zipper fashion and are physically disposed on distinct gauge pads 134, as illustrated in FIG. 2. That is, the leading portion 130 can be a straight (i.e., zero degree angle) or forward (i.e., negative degree angle) sweeping portion of the blade 116, while the trailing portion 132 can be a rearward (i.e., positive degree angle) sweeping portion of the blade 116 each on a respective gauge pad 134. Alternatively, the leading portion 130 can be a forward (i.e., negative degree angle) sweeping portion of the blade 116 while the trailing portion 132 can be a straight (i.e., zero degree angle) or rearward (i.e., positive degree angle) sweeping portion of the blade 116 each on a respective gauge pad 134.

Figure 3:
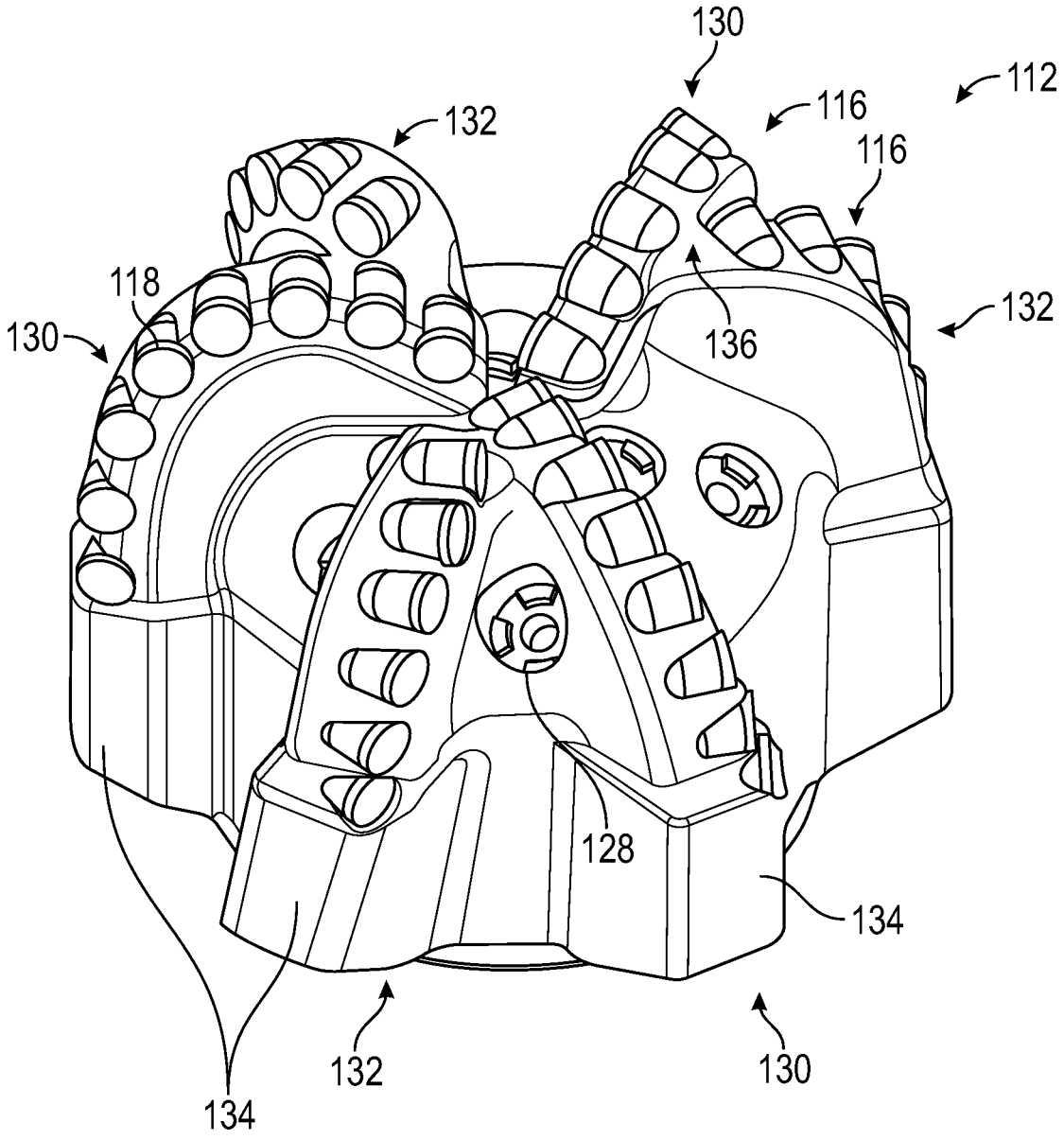
FIG. 3 is a perspective view of the first embodiment of the bit of FIG. 2, in accordance with embodiments of the present technique.

FIG. 3 is a perspective view of the drill bit 112 that provides another vantage point of the blades 116 and their respective leading portion 130 and trailing portion 132 as disposed on respective gauge pads 134. As illustrated in FIG. 3, the split of the blades 116 is attributable to the sweep of the leading portion 130 and trailing portion 132. For example, the leading portion 130 and trailing portion 132 may have a threshold amount of angle change therebetween. This may be represented by a helix number and may be characterized as degrees of helix on the bit. This angle change may be, for example, approximately 1°, approximately 2°, approximately 3°, approximately 4°, approximately 5°, approximately 6°, approximately 7°, approximately 8°, approximately 9°, approximately 10°, or another value. As used herein, the term approximately can denote a deviation of +/−1°, +/−0.75°, +/−0.5°, +/−0.25°, or another value.

Likewise, the angle change may be, for example, between approximately 1°-2°, between approximately 2°-3°, between approximately 3°-4°, between approximately 4°-5°, between approximately 5°-6°, between approximately 6°-7°, between approximately 7°-8°, between approximately 8°-9°, between approximately 9°-10°, between approximately 1°-3°, between approximately 2°-4°, between approximately 3°-5°, between approximately 4°-6°, between approximately 5°-7°, between approximately 6°-8°, between approximately 7°-9°, between approximately 8°-10°, between approximately 1°-5°, between approximately 5°-10°, or another value. Additionally, the angle change may be consistent across the blades 116 of the drill bit 112. In other embodiments, one or more of the blades 116 may have its own angle change between the leading portion 130 and the trailing portion 132. For example, a first blade may have an angle change between approximately 3°-6° between the leading portion 130 and the trailing portion 132, and a second blade may have an angle change between approximately 7°-9°.

Thus, the angle change described above may be a helix differential (or helix angle differential). For example, for a given blade 116, the leading portion 130 may have an angle of approximately −3° (as it is forward sweeping) while the trailing portion 132 may have an angle of approximately 3° (as it is rearward sweeping). Thus, the helix differential for this blade 116 would be 6° as the angle change between the leading portion 130 and the trailing portion 132. In some embodiments, the leading portion 130 may have a negative helix angle (as it is forward sweeping) while the trailing portion 132 may have a positive helix angle (as it is rearward sweeping). Furthermore, as previously noted, the angles chosen between different blades 116 of the drill bit 112 may differ from one another. For example, a drill bit 112 may have a first blade 116 with a leading portion 130 having a negative helix angle of −3° and a trailing portion 132 having a positive helix angle of 1°, a second blade 116 with a leading portion 130 having a negative helix angle of −2° and a trailing portion 132 having a positive helix angle of 2°, and a third blade 116 with a leading portion 130 having a negative helix angle of −3° and a trailing portion 132 having a positive helix angle of 1°. That is, symmetrical or asymmetrical helix angles are envisioned for the blades 116 and the determination of the helix angles can be chosen based upon, for example, available space for the blades 116 on the drill bit 112, resultant forces on the cutting elements 118, and/or other factors.

As previously noted, each of the leading portion 130 of the blade 116 and the trailing portion 132 of the blade 116 has its own corresponding gauge pad 134. These gauge pads 134 may be at independent sweep angles, for example, in order to optimize the space between them for cuttings evacuation. For example, as illustrated in FIG. 3, the gauge pad 134 of the leading portion 130 of the blade 116 is at a 0° beta angle while the gauge pad 134 of the trailing portion 132 of the blade 116 is at a 10° beta angle. However, other angles are contemplated. As discussed herein, the beta angle is an angle with the bit axis such that a 10° beta angle for the gauge pad 134 has a leading portion 130 nearest the shoulder region that rotationally leads the leading portion 130 towards the bit connection.

The azimuth angle between gauge pads 134 of the leading portion 130 and the trailing portion 132 of the split blade 116 may be less than the azimuth angle between the gauge pads 134 of adjacent blades. That is, the azimuth angle between the gauge pads 134 of the leading portion 130 and the trailing portion 132 of a first split blade may be less than the azimuth angle between the gauge pads 134 of the leading portion 130 of the first split blade and the gauge pads 134 of the trailing portion 132 of an adjacent second split blade. Likewise, the azimuth angle between the gauge pads 134 of adjacent split blades may be greater than the azimuth angle between gauge pads 134 of the leading portion 130 and the trailing portion 132 within a split blade. In some embodiments, the azimuth angle between the gauge pads 134 of adjacent split blades is more than 10%, 15%, or 20% or more greater than the azimuth angle between gauge pads 134 of the leading portion 130 and the trailing portion 132 within a split blade.

Additionally, the cutting elements 118 on the leading portion 130 of the blade 116 and the trailing portion 132 of the blade 116 may have unique shapes, unique types, unique grades, may be at independent positions, and/or may have independent back rake and/or side rake angles. However, in other embodiments, gauge pads 134 may be at independent swept angles and/or the cutting elements 118 on the leading portion 130 of the blade 116 and the trailing portion 132 of the blade 116 may have common shapes or grades, may be at similar positions, and/or may have common independent back rake and/or side rake angles.

One advantage of the present drill bit 112 is its ability to function across formations with multiple lithologies. During high depth of cut (DOC) scenarios (e.g., 900 feet per hour, 275 meters per hour, or another similar rate), the leading portion 130 of the blades 116 does the majority of the formation removal, and during low depth of cut scenarios (e.g., 80 feet per hour, 25 meters per hour, or another similar rate such as, for example, a rate of 1/50 of the rate of a high DOC scenario, a rate of 1/75 of the rate of a high DOC scenario, a rate of 1/100 of the rate of a high DOC scenario, or another value), the load is split evenly between the leading portion 130 and the trailing portion 132. This is illustrated in FIG. 4.

Figure 4:
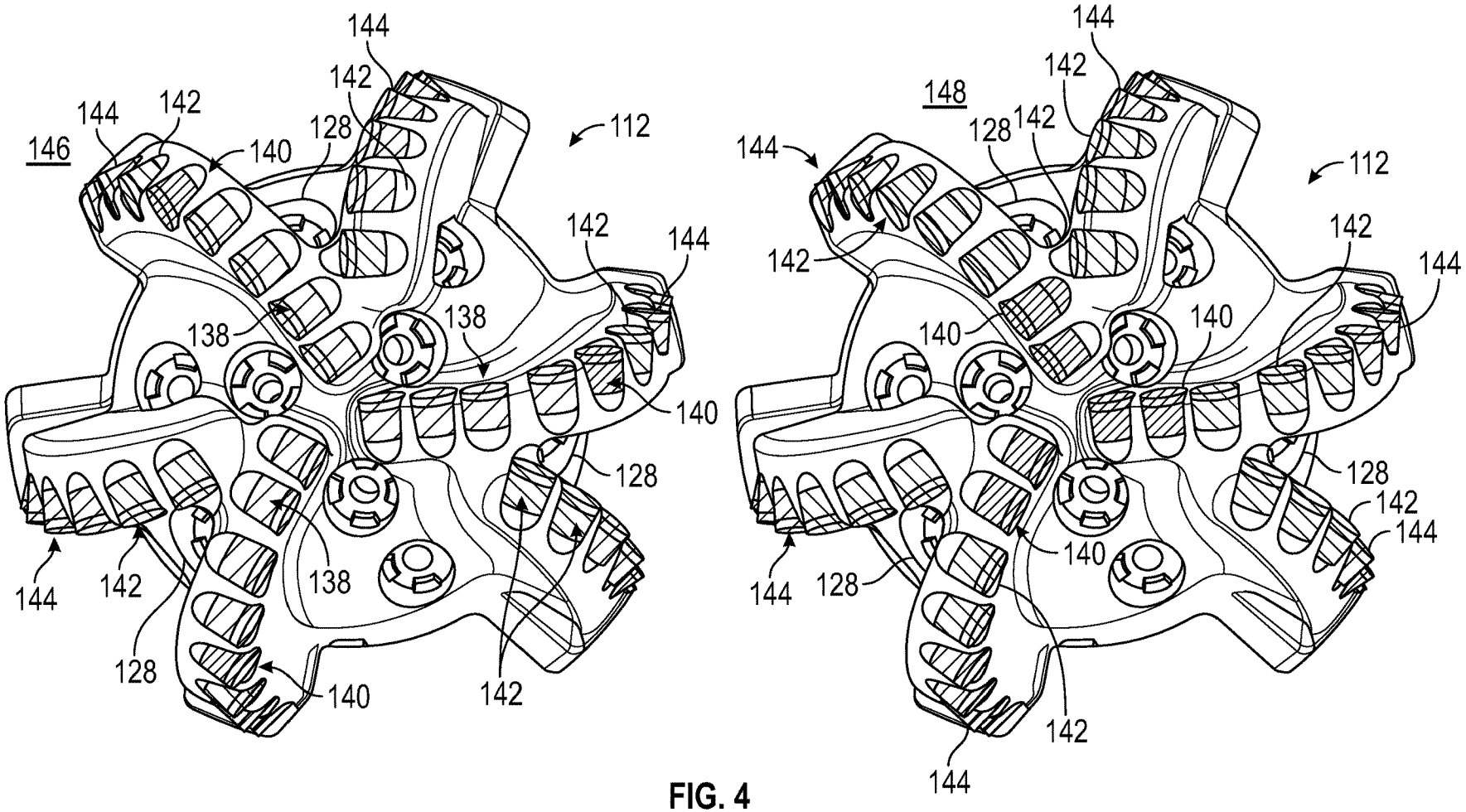
FIG. 4 is a top view of the first embodiment of the bit of FIG. 2 when used in distinct drilling formations, in accordance with embodiments of the present technique.

FIG. 4 illustrates the drill bit 112 experiencing a high DOC resulting in a group 138 of cutting elements 118 experiencing high DOC loading, a group 140 of cutting elements 118 experiencing medium DOC loading, a group 142 of cutting elements 118 experiencing low DOC loading, and a group 144 of cutting elements 118 experiencing minimal DOC loading when the drill bit is operating in a formation having a first type of lithology that allows for greater penetration per revolution of the drill bit 112, as illustrated by image 146. In contrast, as illustrated in image 148, the drill bit 112 is experiencing a low DOC, resulting in a group 140 of cutting elements 118 experiencing medium DOC loading, a group 142 of cutting elements 118 experiencing low DOC loading, and a group 144 of cutting elements 118 experiencing minimal DOC loading when the drill bit 112 is operating in a formation having a second type of lithology that allows for less penetration per revolution of the drill bit 112 relative to the high DOC in image 146. Thus, for the illustrated example in FIG. 4, the drill bit 112 functionally operates as a six bladed bit for a low DOC scenario and a three bladed bit for a high DOC scenario. This flexibility of the drill bit 112 allows for its use in formations having varied lithology without having to transition from one bit type to another. This reduces downtime, for example, time needed to switch bits and, accordingly, reduces drilling costs.

Additionally, the differential sweeping (i.e., forward and rearward sweeping) of the leading portion 130 of the blade 116 and the trailing portion 132 of the blade 116 can allow for additional space to provide for advantageous hydraulic cleaning layouts. For example, as illustrated in FIG. 4, as the leading portion 130 of the blade 116 and the trailing portion 132 of the blade 116 separate due to their differences in helix angles (and their angles being negative and positive, respectively), additional areas on the bit body 114 become exposed. In some embodiments, one or more additional fluid ports 128 (as illustrated in FIG. 4) can be disposed in the area between the leading portion 130 of the blade 116 and the trailing portion 132 of the blade 116. These fluid ports 128 can be beneficial in high DOC scenarios, as they can operate to provide additional fluid for flushing of cuttings (i.e., when the size of the cuttings is larger). Likewise, these fluid ports 128 can be additionally useful in low DOC scenarios, as they provide additional cooling, for example, to the cutting elements 118 disposed on the trailing portion 132 of the blade 116. The flow channels between the leading portion 130 and the trailing portion 132 of the blade 116 may be more narrow than junk slots of the bit 112. Moreover, flow channels between the leading portion 130 and the trailing portion 132 of a split blade 116 do not extend to the bit axis.

In some embodiments, one or more of the cutting elements 118 on the leading portion 130 may be a different type than the one or more cutting elements 118 on the trailing portion 132 of the split blade. For example, the one or more cutting elements 118 on the leading portion 130 may be wear resistant cutting elements or milling cutting elements, such as tungsten carbide cutting elements, and the one or more cutting elements 118 on the trailing portion 132 may be ultra hard cutting elements (e.g., planar elements or non-planar elements). In another example, the one or more cutting elements 118 in a shoulder region of the leading portion 130 may be rounded tungsten carbide elements, and the one or more cutting elements 118 in the shoulder region of the trailing portion 132 may be planar or non-planar ultra hard cutting elements. In some embodiments, the one or more cutting elements 118 on the leading portion 130 may be more impact resistant than the one or more cutting elements 118 on the trailing portion 132. Alternatively, the one or more cutting elements 118 on the trailing portion 132 may be more impact resistant than the one or more cutting elements 118 on the leading portion 130. The more impact resistant cutting elements arranged differentially on the leading portion 130 or the trailing portion 132 of a split blade may have the same or greater exposure than the cutting elements arranged on the other portion of the split blade.

Figure 5:
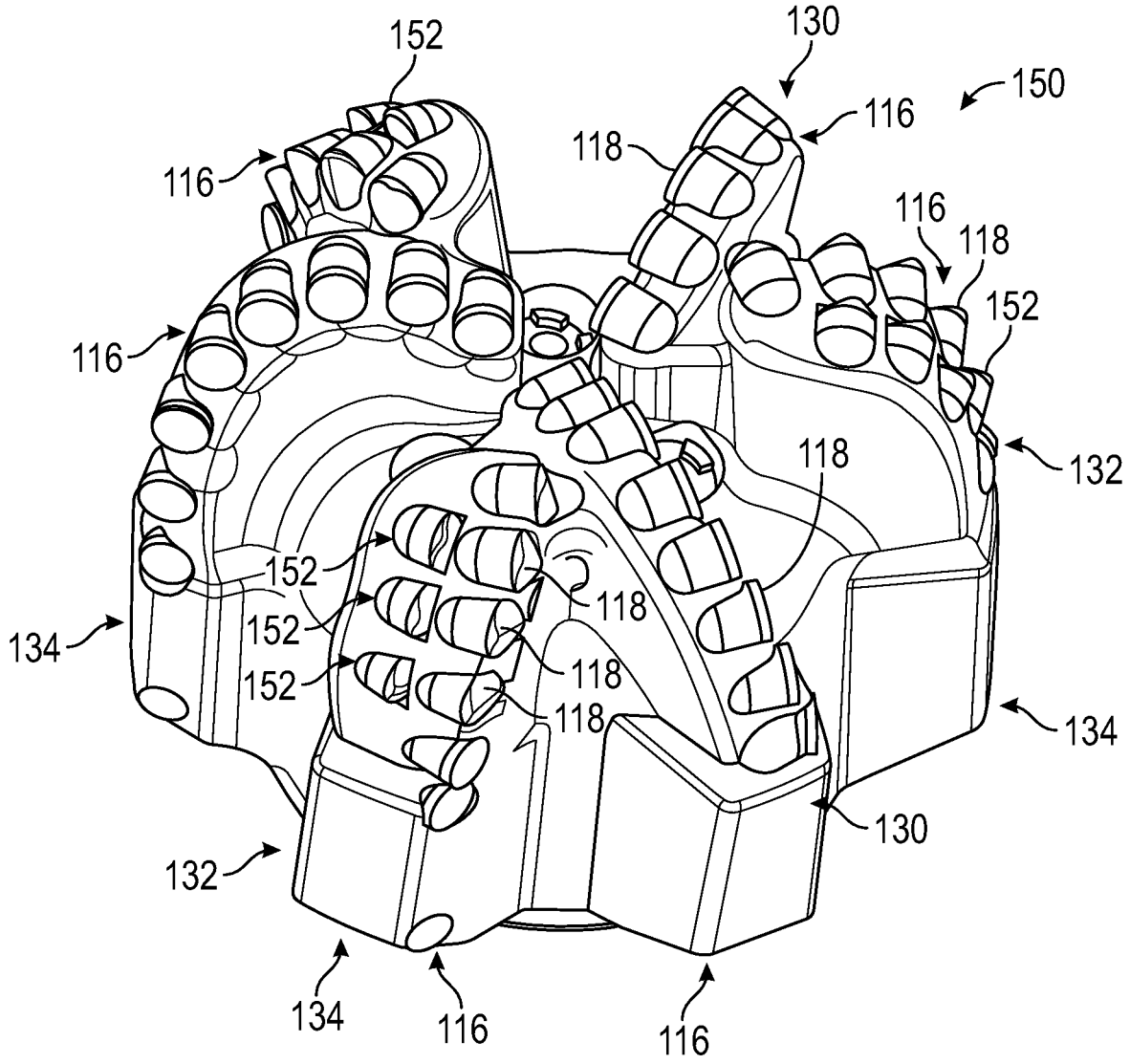
FIG. 5 is a perspective view of a second embodiment of the bit of the drilling system of FIG. 1, in accordance with embodiments of the present technique.

FIG. 5 illustrates a perspective view of a drill bit 150 that can be utilized as the drill bit 110 of FIG. 1 in place of the drill bit 112 of FIGS. 2-4. While the drill bit 150 is similar to the drill bit 112, the drill bit 150 illustrates that backup cutting elements 152 can be disposed on one or both of the leading portion 130 of the blade 116 and/or the trailing portion 132 of the blade 116 in addition to the cutting elements 118 discussed above with respect to drill bit 112. For example, as illustrated in FIG. 5, the trailing portion 132 of the blades 116 includes backup cutting elements 152 disposed behind cutting elements 118 on the trailing portion 132 of the blades 116. The cutting elements 118 can be a different type of cutting element than the backup cutting elements 152. For example, the cutting elements 118 can be planar cutting elements while the backup cutting elements 152 can be non-planar cutting elements. In some embodiments, the cutting elements 118 and the backup cutting elements 152 may have unique shapes or grades, may be at independent positions, and/or may have independent back rake and side rake angles. However, in other embodiments, the cutting elements 118 and/or the backup cutting elements 152 may have common shapes or grades, may be at similar positions, and/or may have common independent back rake and/or side rake angles.

The subject matter described in detail above may be defined by one or more clauses, as set forth below.

A bit for removing material from a formation, the bit includes a bit body having a first gauge pad and a second gauge pad and a first blade having a leading portion and a trailing portion, wherein the leading portion is disposed on the first gauge pad with a negative helix angle and the trailing portion is disposed on the second gauge pad with a positive helix angle.

The bit of the preceding clause, wherein a difference between the negative helix angle of the leading portion and the positive helix angle of the trailing portion is at least above a threshold value.

The bit of any preceding clause, wherein the threshold value is a helix differential of between approximately 4° and 8°.

The bit of any preceding clause, wherein the bit body includes a region between the leading portion and the trailing portion having a fluid port disposed therein.

The bit of any preceding clause, wherein the first gauge pad is disposed at a first sweep angle on the bit body.

The bit of any preceding clause, wherein the first sweep angle is approximately 0°.

The bit of any preceding clause, wherein the second gauge pad is disposed at a second sweep angle on the bit body.

The bit of any preceding clause, wherein the second sweep angle is approximately 10°.

The bit of any preceding clause, wherein the trailing portion further includes first cutting elements disposed on a first face of the trailing portion, wherein the first cutting elements are configured to interface with the formation.

The bit of any preceding clause, wherein the trailing portion further includes second cutting elements disposed in a region adjacent a trailing edge of the trailing portion, wherein the second cutting elements are configured to interface with the formation.

The bit of any preceding clause, wherein at least one cutting element of the first cutting elements includes a first type of cutting element, wherein at least one second cutting element of the second cutting elements includes a second type of cutting element.

A bit for removing material from a formation, the bit including a bit body having a first gauge pad and a second gauge pad and a first blade having a first leading portion and a first trailing portion, wherein the first leading portion is disposed on the first gauge pad and the first trailing portion is disposed on the second gauge pad such that there is a first helix angle differential of at least a first threshold value between the first leading portion and the first trailing portion.

The bit of the preceding clause, wherein the at least a first threshold value includes an angle of between approximately 4° and 8°.

The bit of any of the preceding two clauses, wherein the bit body further has a third gauge pad and a fourth gauge pad, wherein the bit further has a second blade.

The bit of any of the preceding three clauses, wherein the second blade includes a second leading portion and a second trailing portion, wherein the second leading portion is disposed on the third gauge pad and the second trailing portion is disposed on the fourth gauge pad.

The bit of any of the preceding four clauses, including a second helix angle differential of at least a second threshold value between the second leading portion and the second trailing portion.

The bit of any of the preceding five clauses, wherein the at least a second threshold value includes a second angle different than the first angle, such as between approximately 5° and 9°.

A bit for removing material from a formation, the bit including a bit body having a first gauge pad and a second gauge pad and a first blade having a first leading portion and a first trailing portion, wherein the first leading portion is disposed on the first gauge pad with a forward sweeping orientation in a first direction towards rotation of the bit when the bit is in operation and the first trailing portion is disposed on the second gauge pad with a rearward sweeping orientation in a second direction away from the rotation of the bit when the bit is in operation.

The bit of the preceding clause, including a helix angle differential of at least a threshold value between the first leading portion and the first trailing portion.

The bit of the any of the preceding two clauses, wherein the bit body includes a third gauge pad and a fourth gauge pad, wherein the bit includes a second blade having a second leading portion and a second trailing portion, wherein the second leading portion is disposed on the third gauge pad and the second trailing portion is disposed on the fourth gauge pad.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. A bit for removing material from a formation, the bit comprising:

a bit body comprising a first gauge pad and a second gauge pad, wherein the first gauge pad is disposed at a first sweep angle on the bit body, the first sweep angle being approximately 0°, and wherein the second gauge pad is disposed at a second sweep angle on the bit body different than the first sweep angle, the second sweep angle being approximately 10°; and a first blade comprising a leading portion and a trailing portion, wherein the leading portion is disposed on the first gauge pad with a negative helix angle and the trailing portion is disposed on the second gauge pad with a positive helix angle, wherein the bit body further comprises a region between the leading portion and the trailing portion.

2. The bit of claim 1, wherein a difference between the negative helix angle of the leading portion and the positive helix angle of the trailing portion is at least a threshold value.

3. The bit of claim 2, wherein the threshold value is a helix angle differential of between approximately 4° and 8°.

4. The bit of claim 1, wherein the region between the leading portion and the trailing portion has a fluid port disposed therein.

5. The bit of claim 1, wherein the trailing portion further comprises first cutting elements disposed on a first face of the trailing portion and second cutting elements disposed in a region adjacent a trailing edge of the trailing portion, wherein the first cutting elements and the second cutting elements are configured to engage with the formation.

6. The bit of claim 5, wherein at least one cutting element of the first cutting elements comprises a first type of cutting element, wherein at least one second cutting element of the second cutting elements comprises a second type of cutting element.

7. The bit of claim 6, comprising a second blade comprising a second leading portion and a second trailing portion, wherein the second leading portion is disposed on a third gauge pad with a second negative helix angle and the second trailing portion is disposed on a fourth gauge pad with a second positive helix angle.

8. A bit for removing material from a formation, the bit comprising:

a bit body comprising a first gauge pad and a second gauge pad; and a first blade comprising a first leading portion and a first trailing portion, wherein the first leading portion is disposed on the first gauge pad and the first trailing portion is disposed on the second gauge pad such that there is a first helix angle differential of at least a first threshold value between the first leading portion and the first trailing portion, wherein the at least the first threshold value comprises an angle of between approximately 4° and 8°.

9. The bit of claim 8, wherein the bit body further comprises a third gauge pad, wherein the bit further comprises a second blade disposed on the third gauge pad.

10. The bit of claim 9, wherein the second blade comprises a second leading portion and a second trailing portion, wherein the second leading portion is disposed on the third gauge pad and the second trailing portion is disposed on a fourth gauge pad.

11. The bit of claim 10, further comprising a second helix angle differential of at least a second threshold value between the second leading portion and the second trailing portion.

12. The bit of claim 11, wherein the at least a second threshold value is different than the first threshold value.

* * * * *